United States Patent [19]

Nelson

[11] 4,445,232

[45] May 1, 1984

[54] WELDERS GLOVE

[76] Inventor: Larry D. Nelson, 1341 Loch Lomond, Cardiff, Calif. 92007

[21] Appl. No.: 381,204

[22] Filed: May 24, 1982

[51] Int. Cl.[3] ..... A41D 19/00

[52] U.S. Cl. ..... 2/161 R; 2/164; 2/167

[58] Field of Search ..... 2/16, 158, 159, 161 R, 2/163, 164, 168, 65, 66, 167, 161 A

[56] References Cited

U.S. PATENT DOCUMENTS

| | | | |
|---|---|---|---|
| 2,356,032 | 8/1944 | Chanut | 2/164 |
| 3,229,306 | 1/1966 | Bazar | 2/161 A |
| 3,267,486 | 8/1966 | Madnick | 2/164 |
| 3,548,413 | 12/1970 | Jackson | 2/164 |

*Primary Examiner*—Louis Rimrodt
*Assistant Examiner*—Tracy Graveline
*Attorney, Agent, or Firm*—Brown & Martin

[57] ABSTRACT

A welders glove is constructed of deer skin with the stretch axis of the skin forming the palm and back of the hand and fingers oriented to extend transverse to the axis of the hand and with the cuff portion of the glove oriented to extend longitudinally of the hand. A liner of a PVC closed-cell foam lines the three bottom fingers and the bottom half of the palm and back of the hand extending back to the end of the cuff leaving the thumb and forefinger unlined to provide for ease of feel and manipulation of tools by the thumb and forefinger.

8 Claims, 5 Drawing Figures

FIG. 1
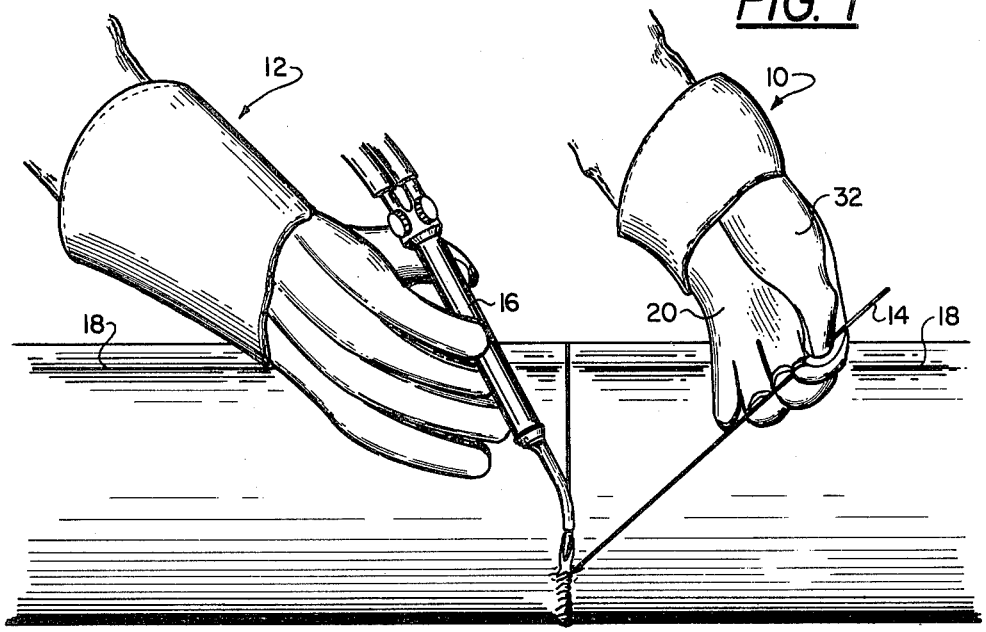
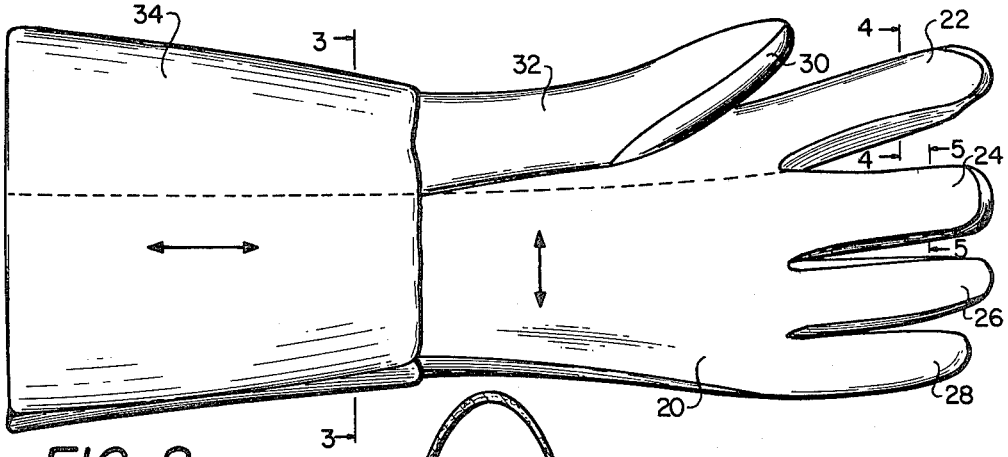
FIG. 2
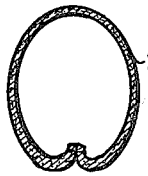
FIG. 4
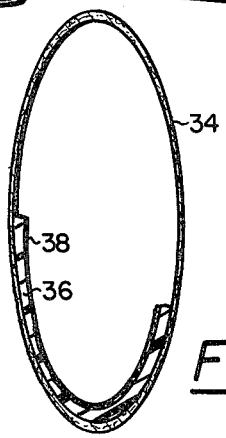
FIG. 3
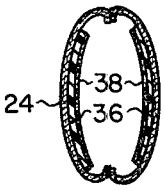
FIG. 5

WELDERS GLOVE

BACKGROUND OF THE INVENTION

The present invention relates to gloves and pertains particularly to welders gloves.

Welders typically wear protective clothing to protect against the heat generated by the welding and to protect against sputtering metal generated during the welding process. This protective clothing is typically required for tungsten inert gas welding, metal inert gas welding, and other forms of welding, such as arc and gas welding.

Such protective wear include protective gloves which are typically a heavy leather of cowhide with a lining of felt or the like for insulation. These and other similar gloves typically used by welders do not leave the welder with much feel of the instruments or tools of his work. A welder must rely heavily upon his vision to tell if he is holding a welding rod or the like in his hand when he is wearing very heavy gloves. Moreover, he has very little, if any, feel of the welding rod during the welding process.

Another problem with such cowhide leather gloves is that they become very stiff after a short period of time of use. Moreover, they have very little stretch or give and, thus, are highly restrictive to movement and manipulation of the hand.

It is therefore desirable that improved protective gloves providing greater feel and greater freedom of movement be available.

SUMMARY AND OBJECTS OF THE INVENTION

It is therefore the primary object of the present invention to provide an improved welders glove.

In accordance with the primary aspect of the present invention, a welders glove is constructed of deer skin with the axis of stretch oriented across the palm and back of the hand and along the longitudinal axis for the cuff.

BRIEF DESCRIPTION OF THE DRAWINGS

The above and other objects and advantages of the present invention will become apparent from the following description when read in conjunction with the drawings wherein:

FIG. 1 is a front elevation view showing the gloves in use.

FIG. 2 is a plan view of the palm of the glove.

FIG. 3 is a view taken generally on lines 3—3 of FIG. 2.

FIG. 4 is a view taken generally on line 4—4 of FIG. 2.

FIG. 5 is a view taken generally on line 5—5 of FIG. 2.

DETAILED DESCRIPTION OF A PREFERRED EMBODIMENT

Turning to the drawings, there is illustrated a pair of gloves in accordance with the invention with a left glove 10 and a right glove 12 shown holding a welding rod 14 and a welding torch 16, respectively, for welding a seam on a pipe 18. The gloves are identical in construction with the only difference being for the right or left hand.

The gloves are constructed of deer skin, which is a much lighter and more flexible leather than cowhide or pig skin or other commonly used materials. Moreover, it has been found that deer skin, despite its light weight and high flexibility, has a longer life in the welding environment of from two to four times than that of cowhide.

The gloves are constructed somewhat in a substantially conventional manner with the palm portion of the glove 20 formed of a substantially single sheet shaped to define the respective finger panels 22, 24, 26 and 28 and the front face 30 of the thumb. The material continues over and forms the back surface of the finger 22. Thus leaving only a single beam across the tip and along the end seam between the fore finger and the second finger of the hand. Separate panels are cut and sewn along the seams as shown in FIG. 1 to form the back of the remaining finger sleeves and the back of the hand back to the cuff. A separate panel 32 is cut, shaped, and sewn in to form the remaining portion of the thumb sleeve. This construction permits the utilization of small scraps of the material to be utilized in the construction and to complete the hand portion of the glove.

A separated elongated extended cuff 34 is constructed of a separate panel of deer skin leather forming a tubular sleeve with the axis of stretch oriented to extend substantially along the longitudinal axis of the arm and hand as shown in the doubled headed arrow. This is in contrast to the arrangement of the palm and hand portion wherein the material forming the palm of the glove and the back including the fingers is selected and oriented such that the stretch grain or axis extends transverse to the longitudinal axis of the hand. With this arrangement, the hand is permitted more flex such that bending the fingers and hand becomes much easier. Since this is not required of the cuff and the cuff is extended over the shirt or other apparel for protection, the longitudinal stretch axis for the cuff is preferred.

An additional feature of the invention is that the glove is only partially lined as shown in FIGS. 2, 3, 4 and 5. The lining covers only the bottom portion of the hand, meaning that portion of the lower three fingers and about two-thirds of the palm and back of the hand with the thumb is in the upright position. This leaves the thumb and fore finger unlined with only the thin skin of the deer skin leather covering the thumb and fore finger, as shown in FIG. 4, thereby providing for a better feel of the article, e.g. welding torch, held between the thumb and forefinger. In addition to giving a better feel, it provides greater flexibility and permits a better manipulation and handling of the articles.

The glove is lined in the portion thereof which is exposed to the heat and highest risk of burning or damage from the heat radiated from the weldment.

As seen in FIGS. 3 and 5, the lining 36 is of a thin material, preferably a closed-cell flexible foam such as a closed-cell polyvinylchloride (PVC). This liner is preferably folded and cut with the panels for extending in the front and back of the lower three finger tubes 24, 26 and 28 as shown in FIG. 5, and is attached such as by gluing or sewing at the very tip of the finger and at the juncture at the front and back of the attachment of the thumb panel portion 32 of the palm or hand portion of the glove. This provides sufficient attachment of the lining to hold it securely within the glove. The lining material is also preferably itself lined by means of a very thin mesh fabric liner 38, such as a knitted cheesecloth-like material that is bonded directly to the face of the liner. This provides an effective cover or lining for the thermal or insulation liner and makes a more comfortable liner than the bare surface of the foam liner.

Thus, with the gloves in accordance with the invention, a more flexible, pliable, easily manipulated glove is provided that outlasts cowhide gloves by at least two and sometimes up to four times. Moreover, the gloves provide a better feel by the thumb and fore finger of the welder to permit better feel and manipulation of the welding materials and implements. The gloves, in accordance with the invention, constructed from deer skin also maintain their flexibility over a longer period of time than cowhide and other materials.

While I have illustrated and described my invention by means of specific embodiments, it is to be understood that numerous changes and modifications may be made therein without departing from the spirit and scope of the invention as defined in the appended claims:

1. A welders glove for protecting the hand of a welder from burning during welding, said glove comprising:

a glove constructed of at least one panel of deer skin leather cut and shaped to define a hand covering with separate finger and thumb pockets, and a cuff extending over the wrist, wherein at least the portion of said panel covering the back of the hand is oriented with the stretch axis transverse to the longitudinal axis of the hand; and a thermal lining covering the lower portion of the hand.

2. The welders glove of claim 1 wherein said thermal lining is made of a closed-cell PVC foam.

3. The welders glove of claim 2 including an elongated cuff, said cuff formed of a panel of leather having the axis of stretch oriented along the longitudinal axis of the hand.

4. The welders glove of claim 1 wherein the thumb and forefinger is unlined.

5. The welders glove of claim 3 wherein the lining is a closed-cell foam covered on the hand engaging surface by a fabric.

6. The welders glove of claim 5 wherein said fabric lining is a knit fabric.

7. The welders glove of claim 6 wherein said lining covers the three lower fingers of the hand, the lower two-thirds of the palm and back of the hand leaving the thumb and forefinger uncovered by the lining.

8. The welders glove of claim 7 wherein said lining in the fingers covers only the front and back thereof.

* * * * *